US008368535B2

(12) United States Patent
Pantus

(10) Patent No.: US 8,368,535 B2
(45) Date of Patent: Feb. 5, 2013

(54) INTRUSION DETECTOR

(75) Inventor: Math Pantus, Brunssum (NL)

(73) Assignee: UTC Fire & Security Americas Corporation, Inc., Brandenton, FL (US)

( * ) Notice: Subject to any disclaimer, the term of this patent is extended or adjusted under 35 U.S.C. 154(b) by 376 days.

(21) Appl. No.: 12/596,790

(22) PCT Filed: Apr. 25, 2008

(86) PCT No.: PCT/NL2008/050253

§ 371 (c)(1),
(2), (4) Date: Mar. 3, 2010

(87) PCT Pub. No.: WO2008/133514

PCT Pub. Date: Nov. 6, 2008

(65) Prior Publication Data

US 2010/0164721 A1 Jul. 1, 2010

(30) Foreign Application Priority Data

Apr. 26, 2007 (NL) ..... 2000616

(51) Int. Cl.
*G08B 13/18* (2006.01)

(52) U.S. Cl. ..... 340/567; 340/564; 340/552; 340/555; 340/556; 250/353; 250/341.8; 250/342

(58) Field of Classification Search ..... 340/552, 340/555, 556, 567, 565; 230/353, 341.8, 230/342; 250/353, 341.8, 342
See application file for complete search history.

(56) References Cited

U.S. PATENT DOCUMENTS

| | | | | | |
|---|---|---|---|---|---|
| 3,703,718 | A | * | 11/1972 | Berman | 340/567 |
| 3,958,118 | A | * | 5/1976 | Schwarz | 250/221 |
| 4,268,752 | A | * | 5/1981 | Herwig et al. | 250/353 |
| 4,375,034 | A | | 2/1983 | Guscott | |
| 4,880,980 | A | * | 11/1989 | Muller et al. | 250/353 |
| 4,939,359 | A | * | 7/1990 | Freeman | 250/221 |
| 5,089,704 | A | * | 2/1992 | Perkins | 250/342 |
| 5,608,220 | A | * | 3/1997 | Wieser et al. | 250/353 |
| 5,626,417 | A | * | 5/1997 | McCavit | 362/276 |
| 6,346,705 | B1 | | 2/2002 | Lee et al. | |
| 6,987,267 | B1 | * | 1/2006 | Monroe et al. | 250/342 |

FOREIGN PATENT DOCUMENTS

| | | |
|---|---|---|
| EP | 0 867 847 B1 | 11/2005 |
| GB | 2 427 265 A | 12/2006 |
| WO | 2006107203 A1 | 10/2006 |

* cited by examiner

*Primary Examiner* — Albert Wong
*Assistant Examiner* — Peter Mehravar
(74) *Attorney, Agent, or Firm* — MH2 Technology Law Group, LLP

(57) ABSTRACT

An intrusion detector comprising a passive sensor for detecting a person entering a space to be monitored, said intrusion detector comprising a housing provided with a window for said passive sensor, optical means for directing electromagnetic radiation from said person onto the passive sensor, alarm means connected to said passive sensor for generating an alarm in case the electromagnetic radiation from said person being detected by the passive sensor corresponds to a signal value that exceeds a maximum level or falls below a minimum level, a special feature being the fact that the optical means are provided with a mirror curved in two directions for forming at least one protective curtain extending in a vertical plane in the space to be monitored, wherein the passive sensor is disposed on the optical axis at the focus of the mirror, and wherein the mirror directs a beam of electromagnetic radiation from the person, rotated through at least 45°, preferably through at least substantially 90°, onto the passive sensor.

10 Claims, 4 Drawing Sheets

INTRUSION DETECTOR

BACKGROUND OF THE INVENTION

1. Technical Field

The invention relates to an intrusion detector comprising a passive sensor for detecting a person entering a space to be monitored, said intrusion detector comprising a housing provided with a window for said passive sensor, optical means for directing electromagnetic radiation from said person onto the passive sensor, alarm means connected to said passive sensor for generating an alarm in case the electromagnetic radiation from said person being detected by the passive sensor corresponds to a signal value that exceeds a maximum level or falls below a minimum level.

2. Background

Such an intrusion detector is known from the present Applicant's International (PCT) patent publication No. 2006/107203. Disposed behind the window of the housing of the known intrusion detector is a passive infrared sensor in the form of a pyro-electrical sensor which is sensitive to infrared light in the far infrared wavelength range. When a burglar, for example, enters the space to be monitored, infrared light (with a wavelength of 6-50 μm) emitted by the burglar (on account of the burglar's body heat) will be detected by the pyro-electrical sensor functioning as a passive infrared sensor, and subsequently an alarm signal will be generated. The intrusion detector, through its pyro-electrical sensor, thus functions as a motion detector. To prevent the intrusion detector being sabotaged while in its state of rest, for example when the pyro-electrical sensor is deactivated during the daytime, for example as a result of lacquer or paint being sprayed on the window or of the intrusion detector as a whole being covered with a hat, a coat or the like, the known intrusion detector is configured with a so-called "anti-masking" or "anti-sabotage" system. Said system thus functions to protect the intrusion detector generally against sabotage attempts, in particular against being approached, masked or damaged. Such "anti-masking" systems generally comprise a light source and a light detector optically coupled thereto, which "monitor" the direct vicinity of the housing as well as the window. When a person approaches the housing and/or the window therein, this will lead to a significant increase or decrease (viz. diffusion/reflection or absorption of emitted light by the person) of the light being detected by the light detector and consequently to an alarm signal being generated.

U.S. Pat. No. 4,375,034 (Guscott) likewise discloses a passive infrared intrusion detection system disposed in a space to be monitored. The intrusion detection system disclosed therein comprises a focussing mirror and a cylindrical mirror which cooperates therewith to form a protective curtain in the space to be monitored, with a pyro-electrical sensor being disposed on the optical axis at the focus of the focussing mirror. When an intruder moves through the protective curtain—in the operative condition of the intrusion detection system—the focussing mirror will focus infrared light emitted by the burglar (on account of the latter's body heat) onto the pyro-electrical sensor via the cylindrical mirror, which will detect said infrared light. Detection signals corresponding thereto are subsequently electronically processed in order to produce an alarm output to signal the presence of the intruder.

A drawback of the use of several protective curtains as described in the aforesaid U.S. Pat. No. 4,375,034 in passive infrared intrusion detectors known from the aforesaid International (PCT) patent publication No. 2006/107203 is that only a limited number of protective curtains can be formed, whilst in practice there is a growing need for a higher monitoring density, i.e. a larger number of protective curtains. After all, the passive sensor, for example a pyro-electrical sensor which is sensitive to infrared light, has a limited aperture angle, which limits the number of focusing mirrors to be used. Moreover, the use of a larger number of smaller focussing mirrors does not offer a solution, since this would have a disproportionate adverse effect on the desired signal/noise ratio.

SUMMARY OF THE INVENTION

The object of the invention is to provide an improved intrusion detector comprising a passive sensor for detecting a person entering a space to be monitored, wherein in particular a higher monitoring density, i.e. a larger number of protective curtains, can be realised.

In order to accomplish that object, an intrusion detector of the kind referred to in the introduction is characterised in that the optical means are provided with a mirror curved in two directions for forming at least one protective curtain extending in a vertical plane in the space to be monitored, wherein the passive sensor is disposed on the optical axis at the focus of the mirror, and wherein the mirror directs a beam of electromagnetic radiation from the person, rotated through at least 45°, preferably through at least substantially 90°, onto the passive sensor. An at least substantially vertical beam of infrared radiation, for example from an intruder, is thus directed onto the passive sensor in the focus of the mirror, preferably rotated through 90°. In other words, an entering beam of infrared radiation from a vertical object (i.e. a person) emitting infrared radiation is reflected to the focus by the double-curved mirror. This takes place in such a manner that the vertical radiation beam takes effect in the focus through summation of converging reflection images. The use of such a mirror curved in two directions makes it possible to form at least one additional protective curtain in combination with the prior art protective curtains already realised, without there being any question of mutual interference and without the desired signal-noise ratio being adversely affected.

In a preferred embodiment of an intrusion detector according to the invention, the mirror has a mirror-symmetrical configuration for forming at least two protective curtains extending in a vertical plane in the space to be monitored. Said protective curtains are in particular positioned mirror symmetrically relative to a plane of mirror symmetry of the mirror. In this way two (additional) protective curtains are realised on either side of the aforesaid plane of mirror symmetry.

In another preferred embodiment of an intrusion detector according to the invention, the mirror is paraboloid in shape. In particular, the paraboloid mirror has a smooth, for example polished, work surface. In another preferred variant, the paraboloid mirror has a segmented work surface.

In another preferred embodiment of an intrusion detector according to the invention, the paraboloid mirror comprises at least two groups of mirror segments, each group of mirror segments being arranged for forming a protective curtain. Preferably, four mirror segments are provided for each group of mirror segments, so that two (additional) protective curtains are realised. A mirror segment of one group preferably has an angle of inclination or declination ($\alpha$) and an azimuth angle ($\beta$), whilst a mirror segment of another group, which is mirrored therewith, has an angle of inclination or declination $\alpha$) and an azimuth angle ($-\beta$). Mirrored mirror segments thus have the same angle of inclination or declination (both as regards size as regards sign), whilst the azimuth angle of mirrored mirror segments is the same as regards size but different as regards sign (viz. + and −).

In another preferred embodiment of an intrusion detector according to the invention, the mirror is made in one piece, for example of plastic material or a metal.

The invention may be combined with a motion detection system according to the present Applicant's European patent No. 0 967 847. In the present case this means that means are provided for measuring the shape of and the phase relation between first and second detection signals (X, Y) which are measured when an intruder moves through spatially separated protective curtains. This makes it possible to double the number of protective curtains again without any mutual interference, which leads to an even higher monitoring density.

BRIEF DESCRIPTION OF THE DRAWINGS

The invention will now be explained in more detail with reference to figures illustrated in a drawing, in which.

DETAILED DESCRIPTION OF THE INVENTION

Figure 1:
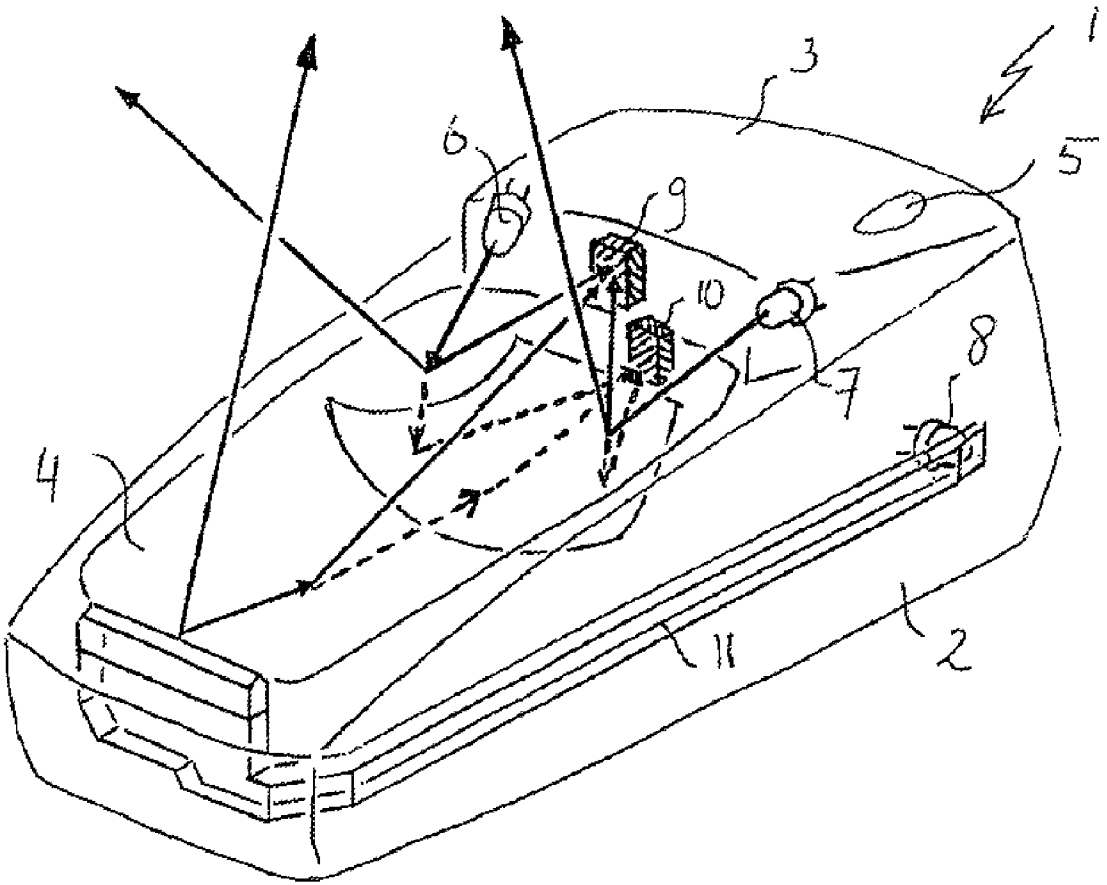
Fig. 1 Prior Art
FIG. 1 is a perspective, schematic view of an intrusion detector as described in the aforesaid International (PCT) patent publication No. 2006/107203.

FIG. 1 shows a perspective, a schematic view of a prior art passive infrared intrusion detector disposed in a space to be monitored, comprising a housing 1 of plastic material, which is made up of a lower housing 2 and an upper housing 3 mounted thereon, a window 4, as well as an alarm light 5. The alarm light 5 lights up in case an alarm is generated when an undesirable object enters the room to be monitored. If desired, said entry is reported to an alarm centre. Disposed behind the window 4 is a passive infrared sensor configured as a pyro-electrical sensor (not shown in FIG. 1), which is sensitive to infrared light in the far infrared wavelength range. When a burglar, for example, enters the room to be monitored, infrared light emitted by the burglar (on account of the burglar's body heat) will be detected by the pyro-electrical sensor, whereupon an alarm signal will be generated. The intrusion detector thus functions as a motion detector. To prevent the intrusion detector being sabotaged while in a state of rest, for example when the pyro-electrical sensor is deactivated during the daytime, the intrusion detector is configured with an improved "antimasking" system or "anti-sabotage" system. As already noted before, said system functions to protect the intrusion detector generally against sabotage attempts, in particular against being approached, masked or damaged. The radiation path shown in FIG. 1 relates to a so-called "anti-masking" system or "anti-sabotage" system of this known passive infrared intrusion detector, in which use is made of infrared light sources 6, 7, 8 for photodiodes 9, 10 sensitive to near-infrared light, and also of an L-shaped light guide 11, for example of polycarbonate. For more detailed information regarding the operations of said system, reference is made to the aforesaid International (PCT) patent publication No. 2006/107203.

Figure 2:
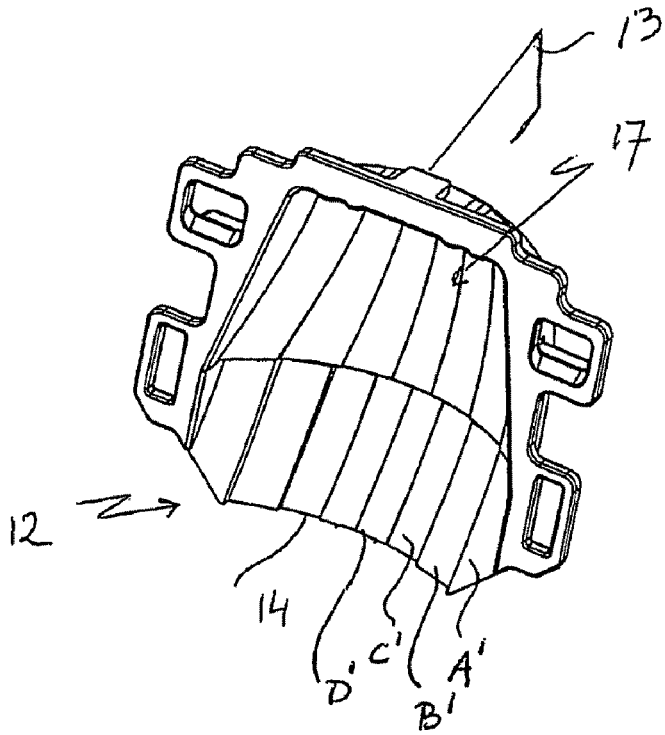
FIG. 2 is a perspective and schematic view of a paraboloid mirror (12) according to the invention, which may be used in the intrusion detector of FIG. 1.
Figure 2:
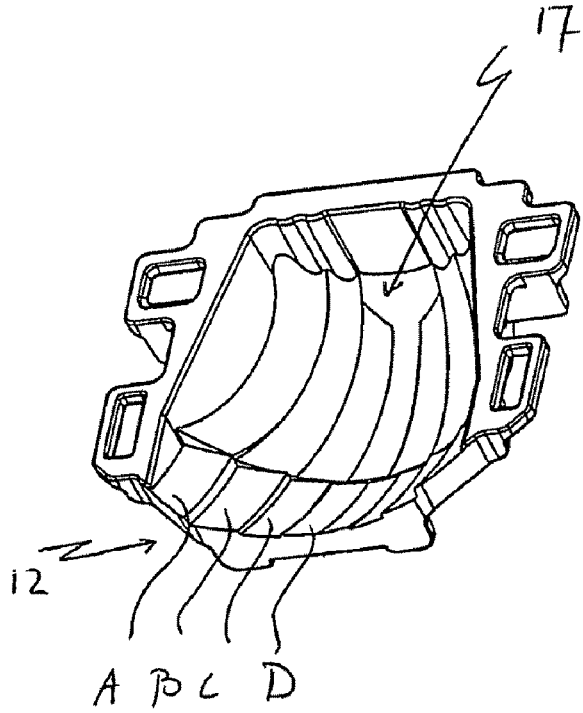
Figure 3:
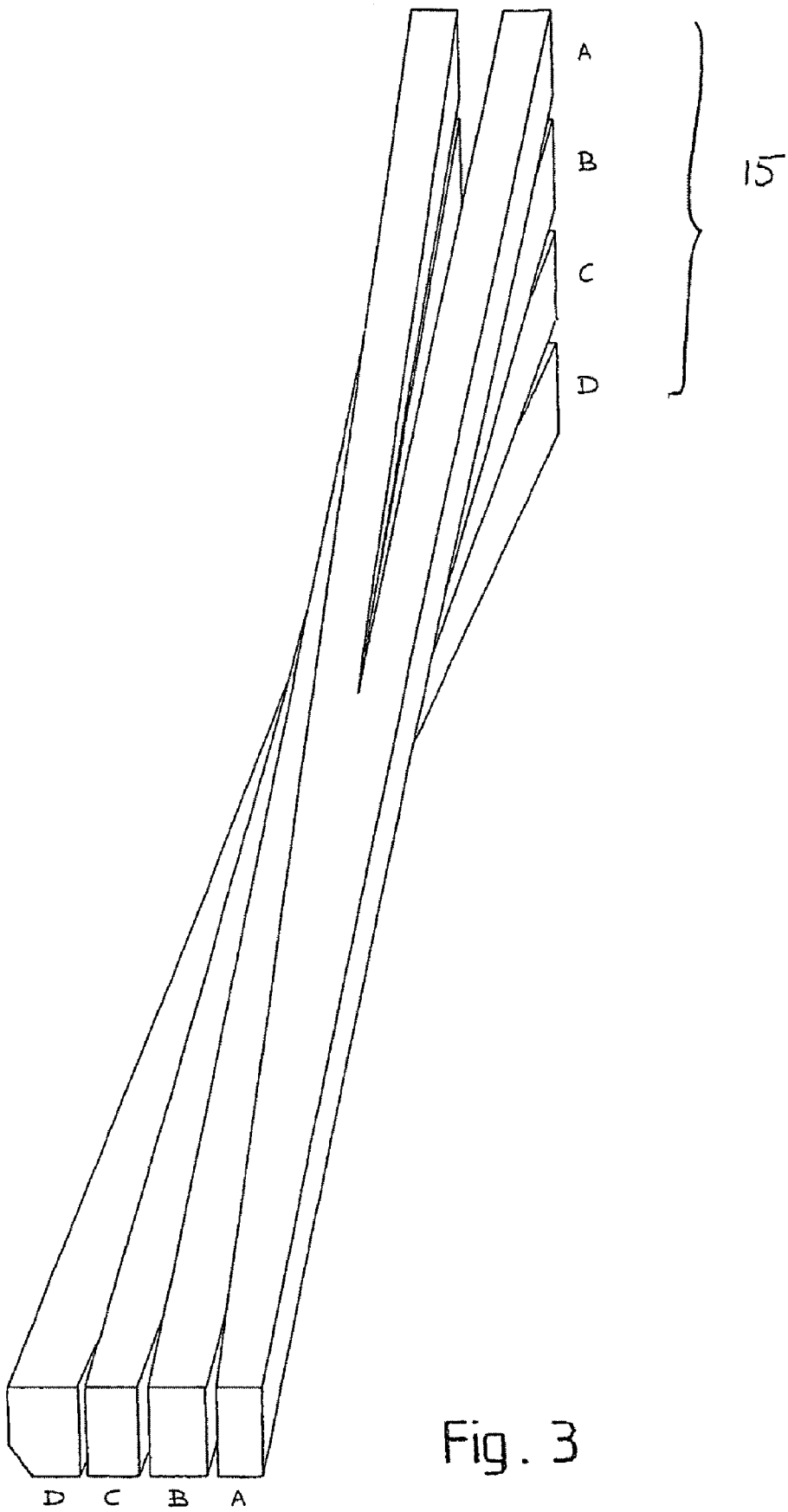
FIGS. 3 and 4 are schematic views of protective curtains associated with the paraboloid mirror (12) of FIG. 2.

FIG. 2 is a perspective and schematic view of a paraboloid mirror 12 according to the invention, which may be used in the intrusion detector of FIG. 1. The mirror 12 is in this case mirror-symmetrical relative to a plane 13 of mirror-symmetry. The mirror 12 further comprises a segmented work surface 14. Said work surface 14 consists of two groups of mirror segments, each consisting of four mirror segments A,B,C,D and A',B',C' and D'. As FIG. 3 shows, one (the "left-hand") group comprising mirror segments A,B,C,D disposed horizontally in the mirror 12 provides a vertical protective curtain 15. Said protective coating 15 is positioned to the right of the plane 13 of mirror-symmetry, seen from the mirror 12. Similarly, the other (the "righthand") comprising mirror segments A',B',C',D' disposed horizontally in the mirror 12 provides a vertical protective curtain 16, which is positioned to the left of the plane 13 of mirror-symmetry, seen from the mirror 12 (see FIG. 4). It is noted that a mirror segment A,B,C,D of one group has an inclination angle ($\alpha$) and an azimuth angle ($\beta$), in which a mirror segment A',B',C',D' of the other group, which is mirrored therewith, has an inclination angle ($\alpha$) and an azimuth angle ($-\beta$). The mirror segments A,B,C,D on the one hand and A',B',C',D' on the other hand have declination of, for example, 3.6°, 6.3°, 8.9° and 11.8°, respectively, whilst the azimuth angle of the mirror segments C,C° is −8.1° and −8.1°, respectively. As FIG. 3 shows, the pyro-electrical sensor comprises two is sensitive elements of opposite polarity. Each element has a width of 1 mm and a length of 2 mm, for example, whilst the zones are for example 1 mm apart (viz. one 0.5 mm to the left of the focus and the other 0.5 mm to the right of the focus, for example). If the focal distance is for example 30 mm from the mirror surface, the detection beam can be recognized from about 30 cm.

Figure 4:
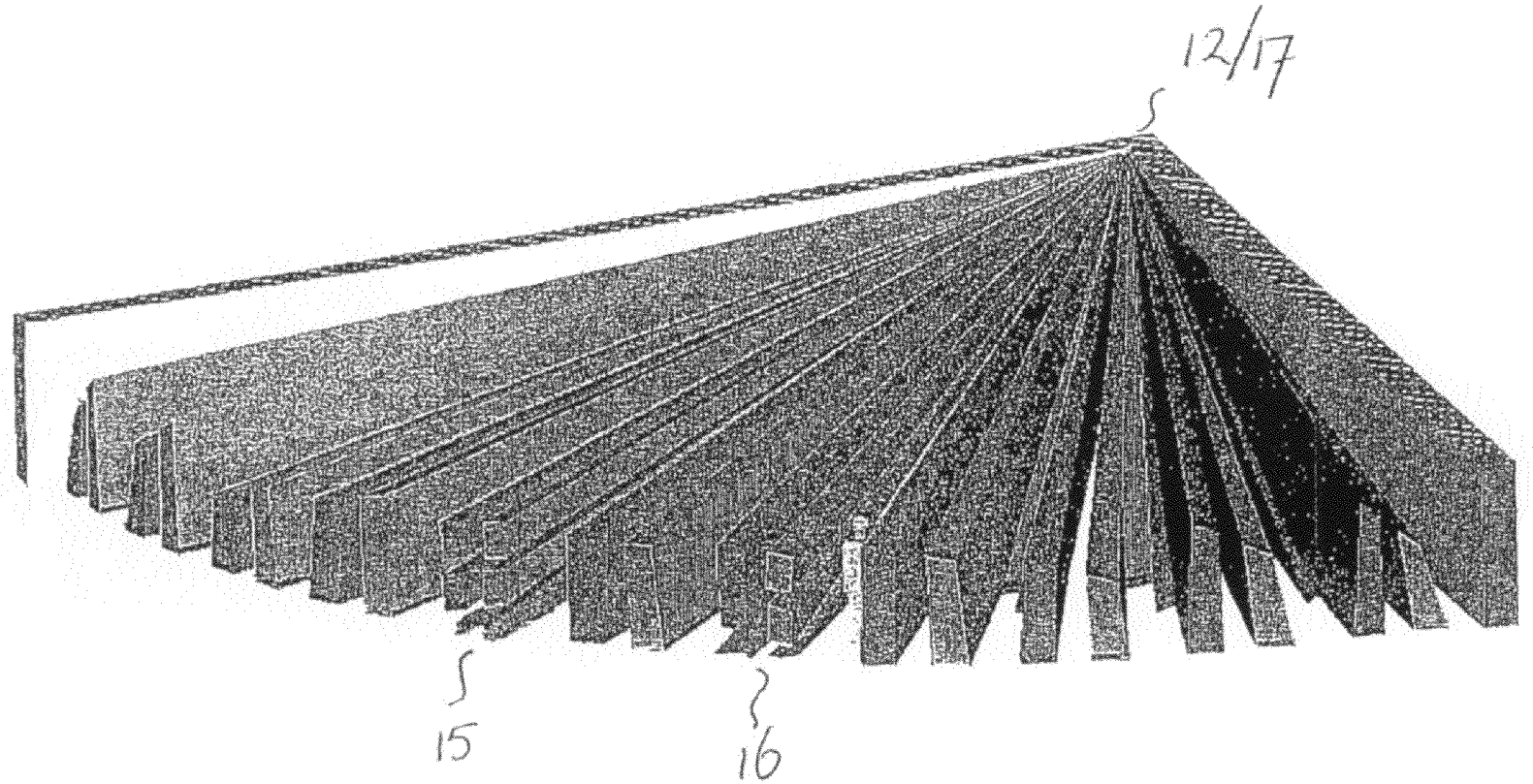

FIG. 4 is another schematic view of the protective curtains 15, 16 as formed by the segmented work surface 14 of the paraboloid mirror 12. In this case, however, nine further protective curtains are shown as well, which protective curtains are formed by a mirror 17 as shown in FIG. 2. Thus, a total of 11 protective curtains are provided, which do not interfere with each other and which realise a higher monitoring density, without the desired signal-noise ratio being adversely affected. The mirrors 12, 17 of FIG. 2 are made in one piece, for example of plastic material.

From FIGS. 3 and 4 it will be understood that the mirror 12 will direct a vertical infrared radiation beam from a burglar, for example, which is coupled into the mirror 12, onto the pyro-electrical sensor as a horizontal infrared radiation beam.

It is noted that the invention is not limited to the embodiment as described herein, but that it also extends to other preferred variants. Thus, a person skilled in the art will appreciate that the paraboloid mirror 12 does not necessarily have to be mirror-symmetrical, in the sense that (i) one group of mirror segments A,B,C,D may suffice for forming one protective curtain, or that (ii) two identical groups of mirror segments A,B,C,D and A',B',C',D', respectively, (each having the same angle of inclination of declination and the same azimuth angle) may be used for realising two adjacent protective curtains.

The invention claimed is:

1. An intrusion detector, comprising:

a passive sensor configured to detect electromagnet radiation associated with an object entering an area to be monitored;

optical means configured to direct the electromagnetic radiation associated with the object to the passive sensor, wherein the optical means are provided with a mirror curved in two directions on a vertical axis for forming at least one protective curtain extending in a vertical plane in the area to be monitored, wherein the mirror comprises at least two groups of mirror segments, and wherein a first mirror segment of one group has a first mirror segment inclination/declination angle equal to $\alpha$ and a first mirror segment azimuth angle equal to $\beta$, and a second mirror segment of a second group has a second mirror segment inclination/declination angle equal to $\alpha$ and a second mirror segment azimuth angle equal to $-\beta$; and an alarm unit connected to the passive sensor, the alarm unit configured to generate an alarm in the event that a value corresponding to the electromagnetic radiation associated with the object being detected by the passive sensor is greater than a maximum value or less than a minimum value, wherein the passive sensor is disposed on an optical axis at a focal distance of the first mirror segment and the second mirror segment.

2. The intrusion detector according to claim 1, wherein the mirror has a mirror-symmetrical configuration forming at least two protective curtains extending in the vertical plane in the area to be monitored.

3. The intrusion detector according to claim 2, wherein the at least two protective curtains are positioned mirror-symmetrically relative to a plane of mirror-symmetry of the mirror.

4. The intrusion detector according to claim 1, wherein the mirror is paraboloid in shape.

5. The intrusion detector according to claim 4, wherein the paraboloid mirror has a smooth work surface.

6. The intrusion detector according to claim 5, wherein the paraboloid mirror has a segmented work surface.

7. The intrusion detector according to claim 1, wherein each group of mirror segments comprises four mirror segments.

8. The intrusion detector according to claim 1, wherein each group of mirror segments comprises greater than four mirror segments.

9. The intrusion detector according to claim 1, wherein the mirror is made in one piece.

10. An intrusion detector, comprising:

a passive sensor configured to detect electromagnet radiation associated with an object entering an area to be monitored;

optical means configured to direct the electromagnetic radiation associated with the object to the passive sensor, wherein the optical means are provided with a mirror curved in two directions on a vertical axis for forming at least one protective curtain extending in a vertical plane in the area to be monitored, wherein the mirror comprises at least two groups of mirror segments, each group of mirror segments being arranged for forming a protective curtain, and wherein a first mirror segment of one group has a first mirror segment inclination/declination angle equal to $\alpha$ and a first mirror segment azimuth angle equal to $\beta$, and a second mirror segment of a second group has a second mirror segment inclination/declination angle equal to $\alpha$ and a second mirror segment azimuth angle equal to $-\beta$; and an alarm unit connected to the passive sensor, the alarm unit configured to generate an alarm in the event that a value corresponding to the electromagnetic radiation associated with the object being detected by the passive sensor is greater than a maximum value or less than a minimum value, wherein the passive sensor is disposed on an optical axis at a focal distance of the mirror, and wherein the mirror directs beams of electromagnetic radiation from the object to the passive sensor such that a summation vertical radiation beam takes effect in the focal distance of the mirror.

* * * * *